US005267419A

United States Patent [19]

Yokota et al.

[11] Patent Number: 5,267,419

[45] Date of Patent: Dec. 7, 1993

[54] PANEL FASTENER CONSTRUCTION

[75] Inventors: Teruo Yokota, Tokyo; Hideyuki Yokoya, Kawasaki; Noriaki Okamoto, Yokohama; Akihiko Takeda, Tokyo, all of Japan

[73] Assignee: YKK Architectural Products, Inc., Tokyo, Japan

[21] Appl. No.: 745,336

[22] Filed: Aug. 15, 1991

[30] Foreign Application Priority Data

Aug. 16, 1990 [JP] Japan ..... 2-214918

[51] Int. Cl.[5] ..... E04B 2/88

[52] U.S. Cl. ..... 52/235; 52/486; 52/512

[58] Field of Search ..... 52/235, 486, 512, 513

[56] References Cited

U.S. PATENT DOCUMENTS

| | | | |
|---|---|---|---|
| 1,662,456 | 3/1928 | De Vol | 52/510 |
| 2,016,918 | 10/1935 | Born | 52/511 |
| 3,621,635 | 11/1971 | De Lange | 52/486 |
| 3,936,986 | 2/1976 | Steel | 52/486 |
| 4,070,835 | 1/1978 | Reverend et al. | 52/486 |
| 4,813,203 | 3/1989 | Newman et al. | 52/235 |

FOREIGN PATENT DOCUMENTS 61-147824 9/1986 Japan .

*Primary Examiner*—James L. Ridgill, Jr.
*Attorney, Agent, or Firm*—Hill, Steadman & Simpson

[57] ABSTRACT

A panel fastener construction is used for fastening a plurality of building panels to a primary structure with a uniform gap interposed between each vertically adjacent panels. The panel fastener construction comprises a plurality pair of upper and lower upward supporting hooks provided on the primary structure with the upper and lower upward supporting hooks vertically spaced from each other, and a pair of upper and lower downward catching hooks provided on the exterior side of each panel for engagement with the upper and lower upward supporting hooks, respectively, of the primary structure. The height of the downward hooks is slightly less than the inter-panel gap.

7 Claims, 10 Drawing Sheets

PANEL FASTENER CONSTRUCTION

BACKGROUND OF THE INVENTION

1. Field of the Invention

The present invention relates to a building panel fastener construction for attaching building panels such as stone panels or glass panels to a primary structure such as panel frames or a skeletons of buildings.

2. Description of the Prior Art

It is known as a type of curtain wall composing the exterior surface of buildings, to mount building panels such as stone panels and glass panels edge-to-edge one after another vertically and horizontally on a primary structure in chessboard like pattern.

There have been various methods of attaching such building panels to a primary structure.

One typical example of such attaching methods is disclosed in Japanese Utility Model Laid-open Publication No. 61-147824, wherein, each building panel is provided on its upper and lower ends with a pair of upper and lower downward catching hooks, respectively. Correspondingly, the skeleton frame of a building is provided with a pair of upper and lower upward supporting hooks in the corresponding locations. The building panels are attached to the skeleton frame of the building with the downward catching hooks of the former snugly fit into the upward catching hooks of the latter. In this conventional method, placing a panel nearly in contact with the building skeleton with the downward catching hooks of the former slightly upward of the upward supporting hooks of the latter and then lowering the panel slightly along the building skeleton would simply cause the panel attached to the building skeleton.

This method of construction provides many advantages. However, this method absolutely requires first placing a panel nearly in contact with the skeleton slightly upward of where it is to go, so that the upper downward catching hooks of the panel to be attached would be liable to butt the lower end of a panel already mounted immediately above. So, it is necessary to mount panels on the skeleton from the bottom to the top of the building skeleton. Furthermore, it is impossible to dismount a broken panel—except those on the uppermost row—from the building skeleton for repair or replacement.

SUMMARY OF THE INVENTION

With the foregoing difficulties in view, it is therefore an object of the present invention to provide a panel fastener construction which has overcome the above-mentioned difficulties.

It is another object of the present invention to provide a panel fastener construction whereby panels can be attached to a primary structure in any order, that is, either from the top or from the bottom thereof.

It is still another object of the present invention to provide a panel fastener construction whereby any broken panel—at what location it may be—can be replaced with a new one at great ease and without interfering with any other panel already attached to a building skeleton.

It is yet another object of the present invention to provide a panel fastener construction which is completely concealed by a panel out of sight, thereby enhancing appearance of the panel construction and hence the building as a whole.

According to the present invention, there is provided a panel fastener construction for fastening a plurality of building panels to a primary structure with a uniform gap interposed between each vertically adjacent panels, the panel fastener construction comprising:

(a) a plurality pair of upper and lower upward supporting hooks provided on the primary structure with the upper and lower upward supporting hooks vertically spaced from each other; and (b) means on each building panel for engaging the panel with the upper and lower upward supporting hooks, the engaging means including a pair of upper and lower downward catching hooks provided on the interior side of each panel for engagement with the upper and lower upward supporting hooks, respectively, of the primary structure, the height of the downward hooks being slightly less than the gap.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The description begins with overall construction of a curtain wall in which this invention is made.

Figure 2:
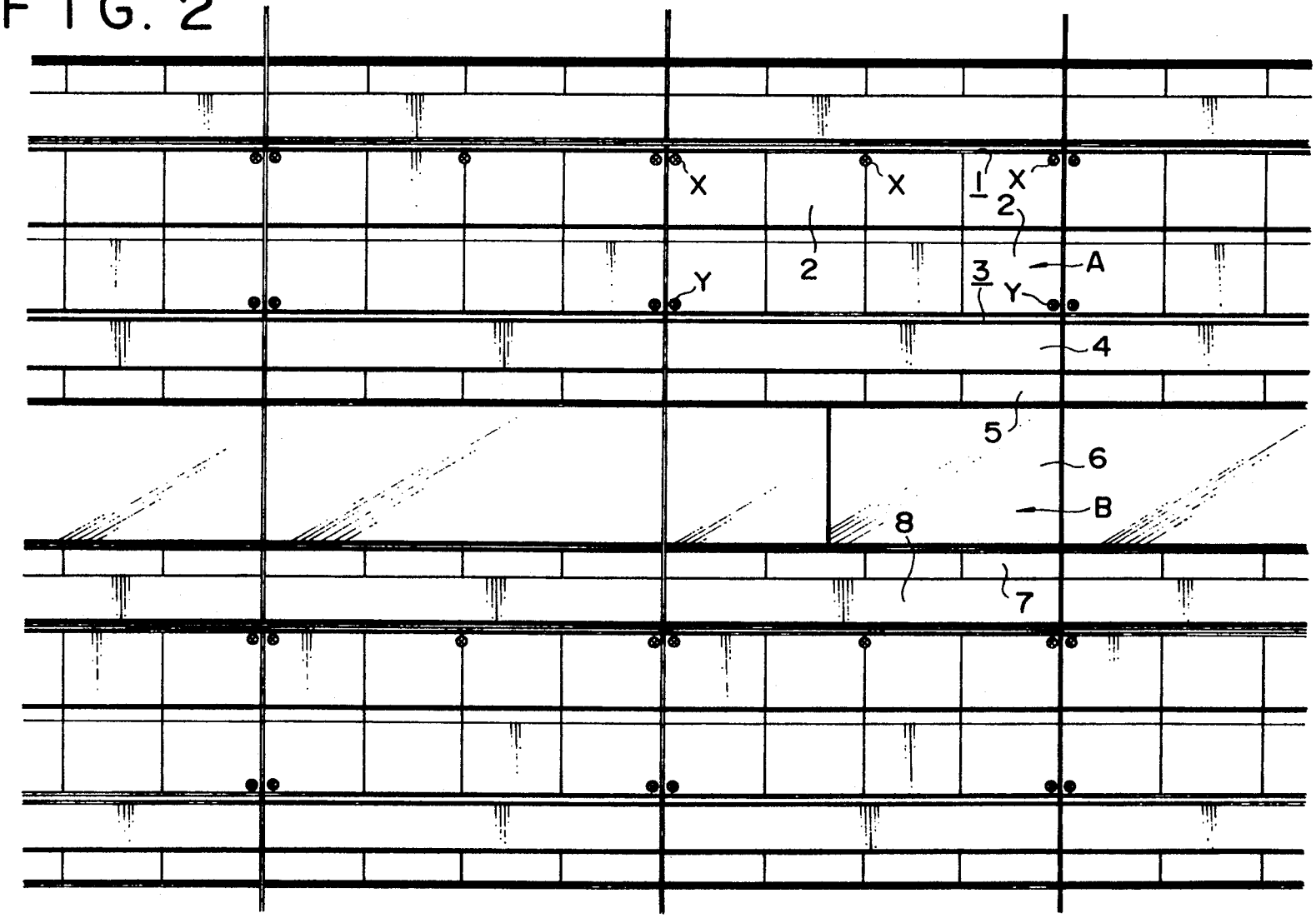
FIG. 2 is a front view of a curtain wall construction in which the panel fastener construction of FIG. 1 is used.
Figure 3:
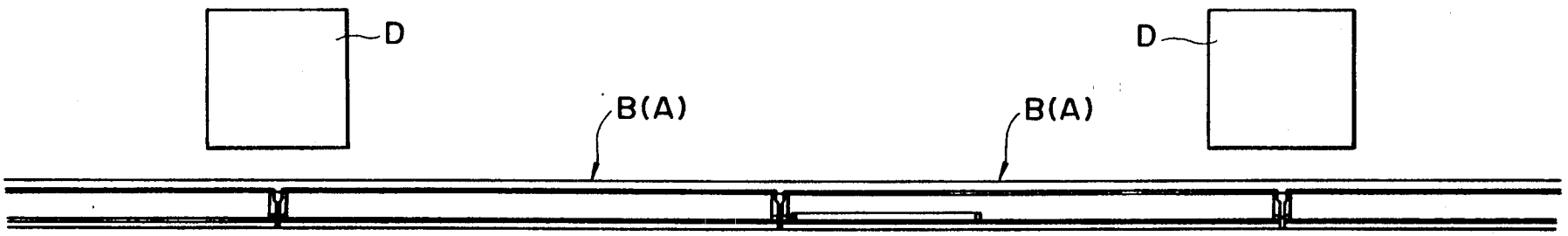
FIG. 3 is a horizontal cross-sectional view of the curtain wall of FIG. 2.
Figure 4:
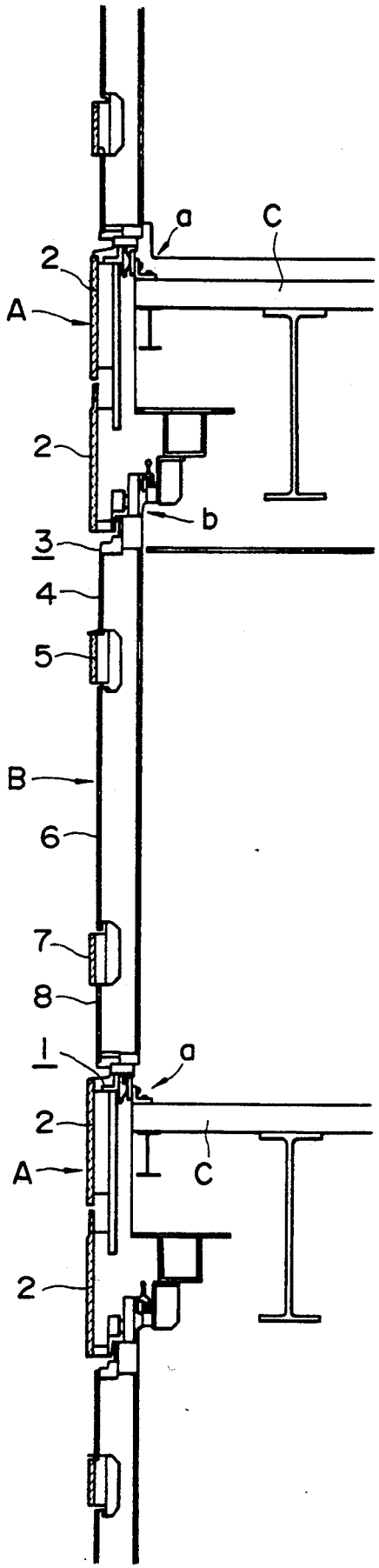
FIG. 4 is a vertical cross-sectional view of the curtain wall construction of FIG. 2.

As shown in FIGS. 2 through 4, several rows of the first panel units A and several rows of the second panel units B are mounted alternately on a skeleton frame of a building. Each of the first panel units A broadly comprises a rectangular frame 1 and a plurality of stone panels 2 attached to its exterior surface of the frame 1 in two, upper and lower rows. The frame 1 of the first panel unit A is mounted at its upper end on a slab C by means of a suitable fastening means X. Each of the second panel units B comprises a rectangular frame 3 and a elongated glass pane 4, a plurality of—four in FIG. 2—stone panels 5 in a row, a plurality of—two—glass panes 6 in row, a plurality of—four—stone panels 7 in a row and an elongated glass pane 8—as named from the top to bottom—attached to its exterior surface of the frame 2. The frame 3 of the second panel unit B is mounted at its upper end on a slab C by means of a suitable fastening means Y, as well as the lower end of the frame 1 of the panel unit A, with the the lower end of the frame 3 overlying the upper end of the frame 1.

Figure 5:
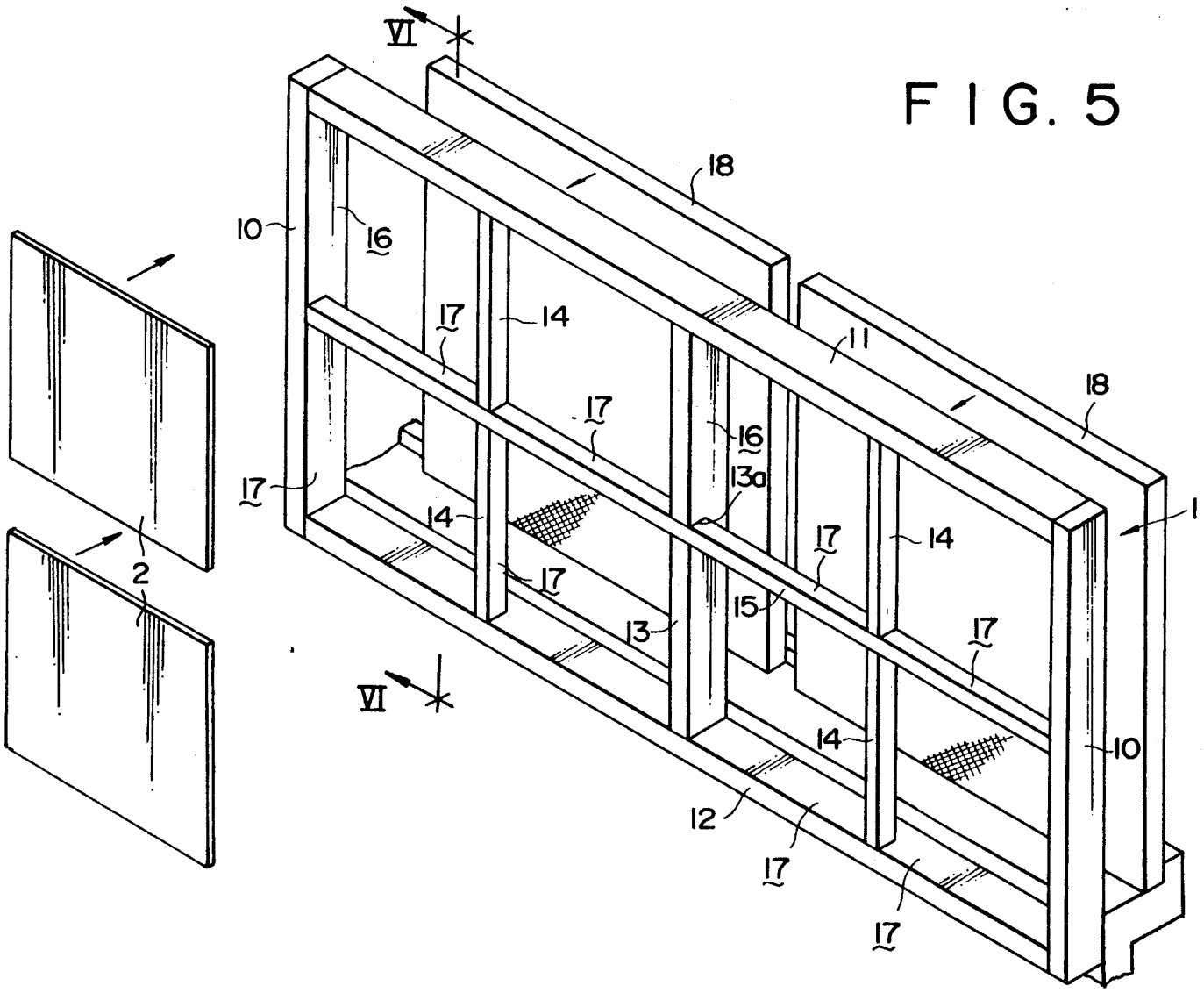
FIG. 5 is a diagramatical prospective view of a frame of a first panel unit composing a part of the curtain wall construction of FIG. 2.

Referring now to the frame 1 of the first panel unit A, the frame 1, as shown in FIG. 5, generally comprises a pair of right and left vertical frame members 10, 10, a pair of upper and lower horizontal frame members 11, 12 each connected its opposite ends with the respective ends of the right and left vertical frame members 10, 10. An intermediate horizontal frame member 15 is connected at its opposite ends to the the opposed vertical frame members 10, 10 at their middles. Furthermore, an intermediate vertical frame member 13 is connected at its opposite ends to the opposed upper and lower horizontal frame members 11, 12 at their middles. The intermediate horizontal and vertical frame members 15, 13 are arranged crisscross to each other with the middle of the intermediate horizontal frame member 15 snugly fit into a notch 13*a* formed in the middle of the intermediate vertical frame member 16. Still further, two vertical mullions 14, 14 are connected at their opposite ends with the upper horizontal frame member 11 and the intermediate horizontal frame member 15 at the locations substantially one quarter of the length of the intermediate horizontal frame member 15 away from the right and left vertical frame member 10, 10, respectively. Similarly, two lower vertical mullions 14, 14 are connected at their opposite ends with the lower horizontal frame member 12 and the intermediate horizontal frame member 15 at the same locations. It is to be noted that the depth of the vertical frame members 10, 10; the upper and lower horizontal member 11, 12 and the intermediate vertical frame member 16 are same as one another, while the depth of the intermediate horizontal frame member 15 and the four mullions 14, 14 are all half the depth of the first-mentioned frame members 10, 10; 11, 12; 16 and that all the frame members 10, 10; 11, 12, 13, 15, 14 are flush with each other at their exterior sides. This arrangement is such that the vertical frame members 10, 10; the upper and lower horizontal frame members 11, 12 and the intermediate vertical frame member 13 define at their interior sides a pair of right and left large rectangular openings 16, 16; while all the frame members 10, 10; 11, 12; 13, 14, 15 define at their exterior sides eight small rectangular openings 17. A pair of fire-proof panels 18, 18 are mounted on the interior side of the frame 1 to enclose the pair of right and left large rectangular openings 16, 16. A plurality of—only one shown in FIG. 5—stone panels 2 are mounted on the exterior side of the frame 1 to enclose the eight small rectangular openings 17. As better shown in FIG. 2, the upper part of the frame 1 of the first panel unit A is fastened at its three points—its right and left corners and its middle—to the slab C by means of suitable fastening means X and the lower part of the frame 1 is fastened at its two points—its right and left corners—to the slab C by means of suitable fastening means Y.

Figure 6:
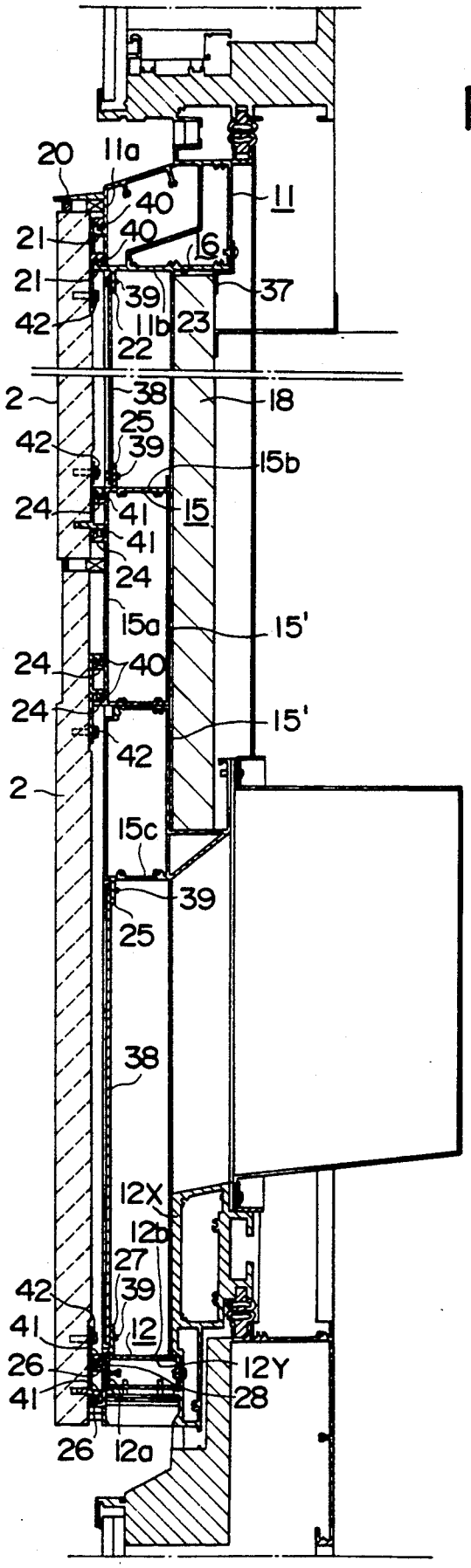
FIG. 6 is a vertical cross-sectional view of the first panel unit taken generally along line VI—VI of FIG. 5.

Referring now to the frame members of the frame 1 of the first panel unit A in detail, as shown in FIG. 6, the upper horizontal frame member 11 is an elongate aluminium extrusion which is a hollow tube of substantially rectangular cross-section. An exterior vertical plate 11*a* of the upper horizontal frame member 11 has at its top end a protruding horizontal edge portion 20 and at its lower portion a pair of upper and lower upward supporting hooks 21, 21. A lower horizontal plate 11*b* of the upper horizontal frame member 11 has an exterior downward lug 22 and a middle downward lug 23at provided integrally adjacent its exterior edge and at its middle, respectively.

The intermediate horizontal frame member 15 is comprised of two, upper and lower frame members 15', 15', the former arranged on the latter, each of which is likewise an elongated hollow extruded tube of rectangular cross-section. A pair of vertically spaced upper and lower upward supporting hooks 24, 24 are mounted on the exterior vertical plate 15*a* of the upper frame member 15'. A upper horizontal plate 15*b* of the upper frame member 15' has adjacent to the exterior edge a upward fin 25, while a lower horizontal plate 15*c* of the lower frame member 15' has adjacent to the exterior edge a downward fin 25. The intermediate horizontal frame member 15 is shown in FIG. 6 to be comprised of two pieces 15', 15', however, it may be constructed in a single piece.

As shown in FIG. 6, the lower horizontal frame member 12 comprises a pair of interior and exterior frame members 12X, 12Y attached to each other in side-by-side relation. A front cover plate 28 is fastened to the front surface of the exterior vertical plate 12*a* of the exterior frame member 12Y by means of screws. The front cover 28 is offset adjacent to its upper edge to provide a upward fin 27 and is provided at the front surface with a pair of upper and lower upward support hooks 26, 26. Alternatively, the pair of upper and lower upward supporting hooks 26, 26 and the upward fin 27 is formed integrally on the front surface of the exterior vertical plate 12*a* and the upper horizontal plate 12, respectively, of the exterior frame member 12*c*.

Figure 7:
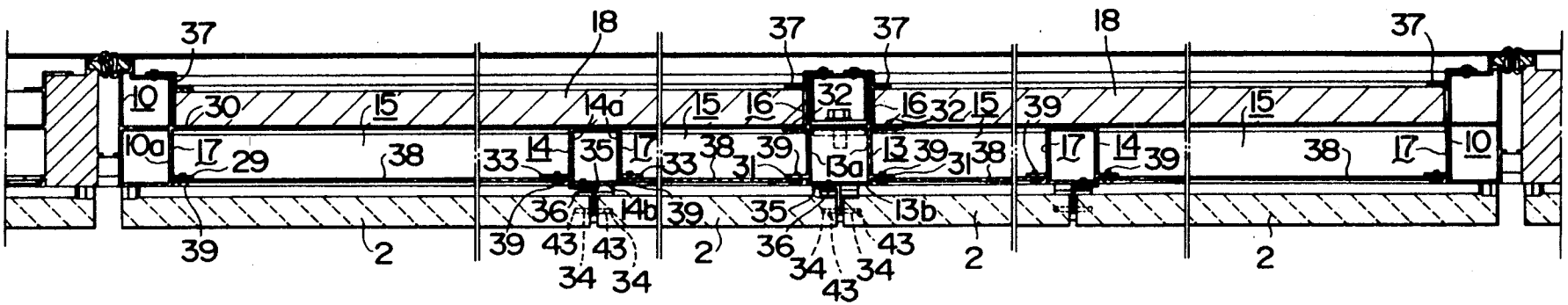
FIG. 7 is a horizontal cross-sectional view of the first panel unit of FIG. 5.

As shown in FIG. 7, each of the right and left vertical frame member 10 is also an elongate hollow tube of substantially rectangular cross-section. The inner vertical plate 10*a* of the vertical frame member 10 has adjacent the exterior edge and on the middle thereof an exterior inward lug 29 and a middle inward lug 30, respectively. The intermediate vertical frame member 13 is similarly an elongate hollow tube of substantially rectangular cross-section. Each of the opposite side plates 13*a*, 13*a* of the intermediate vertical frame member 13 has adjacent the exterior edge and on the middle thereof an exterior inward lug 31 and a middle inward lug 32, respectively. Each vertical mullion 14 is an elongate tube of substantially square cross-section. The opposite side plates 14*a*, 14*a* of the vertical mullion 14 are each provided adjacent to its exterior edge with a inward lug 33. A plurality of brackets 35 are mounted on the the intermediate vertical frame member 13 and the vertical mullion 14 by fastening one arm of each bracket 35 to the respective front vertical plates 13*b*, 14*b*, respectively, thereof by means of screws 36. The other arm is directed outwardly and is provided at its distal end with a dowel 34.

Turning now to how to mount the fire-proof panels 18, the middle inward lugs 23, 30, 32 of the upper horizontal frame member 11, the vertical frame members 10, 10 and the intermediate vertical frame member 13, respectively, continue around the large rectangular opening 16. The fire-proof panel 18 is placed at its edge against the respective middle inward lugs 23, 30, 32 of the upper horizontal frame member 11, the vertical frame member 10 and the intermediate vertical frame member 13 and secured thereto by a plurality of retainer plates 37 screwed at locations to the upper horizontal frame member 11, the vertical frame member 10 and the intermediate vertical frame member 13. The exterior inward lugs 22, 25, 27, 29, 33 of the upper horizontal frame member 11, the intermediate horizontal frame member 15, the lower horizontal frame member 12 and the vertical mullions 14 continue around the exterior small rectangular openings 17. A plurality of water plates 38 are secured to the exterior inward lugs 22, 25, 27, 29, 33 by means of screw to close the exterior small rectangular openings 17 so as to prevent water infiltrated through between stone panels 2 from pass further interiorly, thus coroding the fire-proof panels 18.

Referring now to how to mount stone panels 2, as better shown in FIGS. 6 and 7, the stone panel 2 has anchor bolts 42 planted in its rear surface adjacent the lower and upper ends. A pair of upper and lower downward catching hooks 40, 41 are secured to the rear surface of the stone panel 2 by means of the anchor bolts 42. The upper downward catching hook 40 and the lower downward catching hooks 41 of the upper stone panel 2 are brought into fitting engagement with the upward supporting hook 21 of the upper horizontal frame member 11 and the upper upward supporting hook 24 of the intermediate horizontal frame member 15, respectively. The upper downward catching hook 40 and the lower downward catching hook 41 of the lower stone panel 2 are brought into fitting engagement with the lower upward supporting hook 24 of the intermediate horizontal frame member 15 and the the lower upward supporting hook 26 of the lower horizontal frame member 12. The stone panel 2 has in the opposite edges blind holes 43, into which the dowels 34 of the intermediate vertical frame member 13 and the vertical mullions 14 are fit into.

Figure 8:
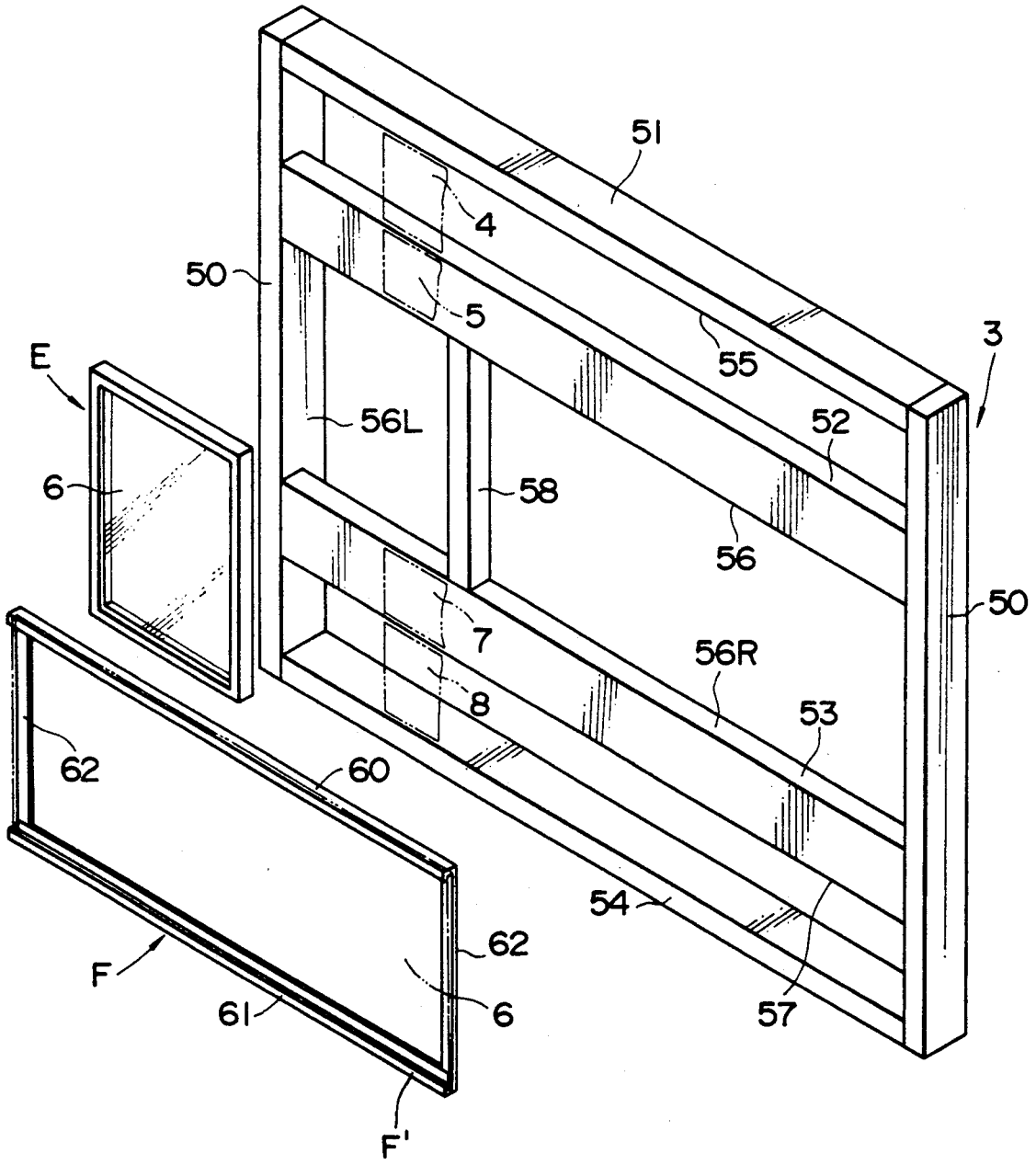
FIG. 8 is a diagramatical prospective view of a frame of a second panel unit composing another part of the curtain wall construction of FIG. 2.

Referring now to the frame 3 of the second panel unit B, as shown in FIG. 8, the frame 3 broadly comprises a pair of right and left vertical frame members 50, 50, and a pair of upper and lower horizontal frame members 51, 54 each connected at its opposite ends with the respective ends of the right and left vertical frame members 50, 50. In addition, a pair of first and second intermediate horizontal frame members 52, 53 are each connected at its ends with the vertical frame members 50, 50 at their respective intermediate locations. The upper horizontal frame member 51 and the first intermediate horizontal frame member 52 define therebetween the first rectangular opening 55; the the first and the second intermediate horizontal frame members 52, 53 define therebetween the second rectangular opening 56; the second intermediate horizontal frame member 53 and the lower horizontal frame member 54 define therebetween the third rectangular opening 57. A vertical mullion 58 is connected at its opposite ends with the first and second intermediate horizontal frame members 52, 52 at their respective intermediate locations, thus dividing the second rectangular opening 56 into a pair of right and left rectangular openings 56R, 56L.

Elongated glass panes 4, 8 are inserted into the first and third rectangular openings 55, 57, respectively. Stone panels 5, 7 are mounted on the respective exterior sides of the first and second intermediate horizontal frame members 52, 53. A window sash E having a glass pane 6 enclosed therein is pivotally mounted in the left rectangular openings 56L, while a panel unit F with a glass pane 6 enclosed therein is fixedly secured in the right rectangular opening 56R. The panel unit F comprises the glass pane 6 and a panel unit frame F' having a pair of right and left vertical frame members 62, 62 and a pair of upper and lower horizontal frame members 60, 61 each connected at its opposite ends with the respective ends of the right and left vertical frame members 62, 62, the glass pane 6 having its periphery bonded to the panel unit frame F'.

Now, description is made of the frame member 3 of the second panel unit B.

Figure 9:
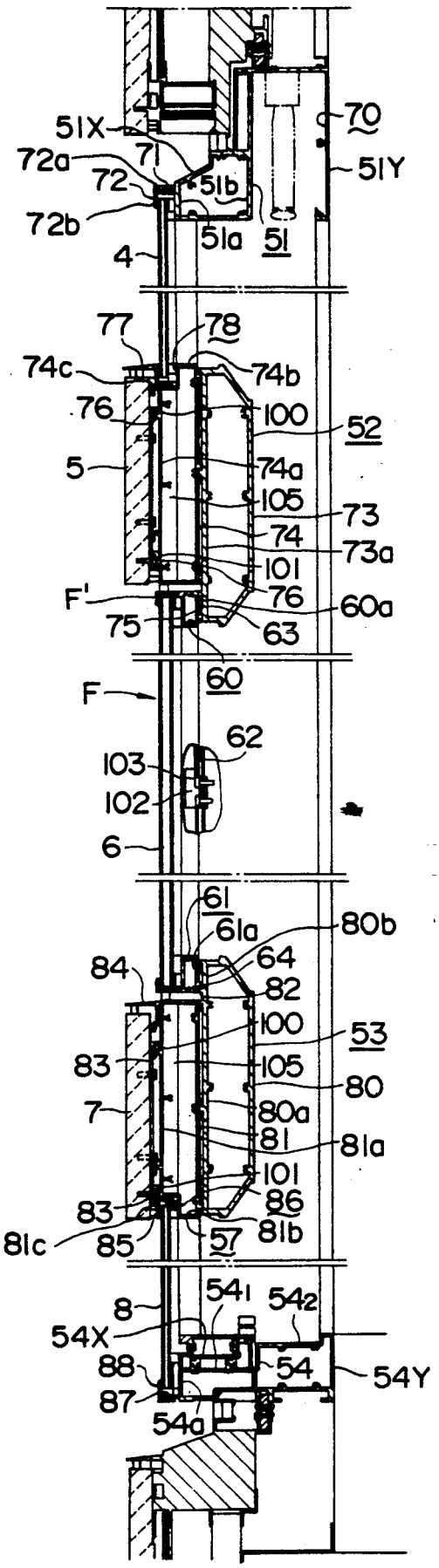
FIG. 9 is a vertical cross-sectional view of the second panel unit of FIG. 8.

As shown in FIG. 9, the upper horizontal frame member 51 of the second panel unit B comprises an exterior frame member 51X which is of the elongated hollow tube of substantially rectangular cross-section and an interior frame member 51Y which extends from the upper end of the exterior member 51X and is of substantially inverted U-shaped cross-section. The inverted U-shaped interior frame member 51Y defines with the exterior vertical plate **51*b* of the exterior frame member 51X a downward-opening channel 70 for housing a blind therein when it is lifted. The upper edge portion of the glass pane 4 is bonded to the lower portion of the exterior vertical plate 51*a* of the exterior frame member 51X. The upper portion of the exterior vertical plate 51*a* has a horizontal ledge 71 extending horizontally outwardly therefrom. A L-shaped retainer plate 72 has its horizontal leg 72*a* secured on the horizontal ledge 71 and its vertical leg 72*b* abutting the front surface of the upper edge portion of the glass pane 4 so as to support the glass pane 4 on the upper horizontal frame member 51**.

As shown in FIG. 9, the first horizontal frame member 52 comprises a first horizontal frame member proper 73 in the shape of an elongated hollow tube of substantially rectangular cross-section and a support frame member 74 similarly in the shape of an elongated hollow tube of substantially rectangular cross-section attached to the exterior vertical plate **73*a* of the first horizontal frame member 73. The exterior vertical plate 73*a* extends downward beyond the lower edge of the the support frame member 74. A retainer lug 75 is mounted on the lower edge of the exterior vertical plate 73*a* of the first horizontal frame member 73 so as to project outwardly therefrom. The exterior vertical plate 74*a* of the support frame member 74 has a pair of upper and lower upward supporting hooks 76, 76 integraly provided on the upper and lower ends, respectively, thereof. The upper horizontal plate 74*b* of the support frame member 74 is offset downward outward to thus form a step 74*c* at a front corner. An angle strip 77 is secured to the step 74*c* to define with the step 74*c* a upward channel 78 for receiving the lower end of the glass pane 4, the lower edge of the glass pane 4 being bonded to the upward channel 78**.

As shown in FIG. 9, the second intermediate horizontal frame member 53 comprises a second horizontal frame member proper 80 in the shape of an elongated hollow tube of substantially rectangular cross-section and a support frame member 81 similarly in the shape of an elongated hollow tube of substantially rectangular cross-section attached to the exterior vertical plate **80*a* of the second horizontal frame member proper 80. The exterior vertical plate 80*a* extends upward beyond the upper edge of the the support frame member 81 to provide a support wall 80*b*. The support wall 80*b* has an upward hook 82 integrally provided on the front surface thereof. The exterior vertical plate 81*a* of the support frame member 81 has a pair of upper and lower upward hooks 83 integrally provided adjacent the upper and lower ends, respectively, thereof. A support strip 84 is screwed to the upper end of the exterior vertical plate 81***a* of the support frame member 81 so as to protrude horizontally outward therefrom. The lower plate 81*b* of the support frame member 81 is offset upwardly outwardly to thus provide a step 81*c*. An L-shaped angle plate 85 is releasably attached to the step 81*c* to define with the step 81*c* a downward channel 86 to receive the upper end of the glass pane 8 fitted in the third rectangular opening 57, the upper end of the glass pane 8 being bonded to the downward channel 86.

The lower horizontal frame member 54 includes a exterior frame member 54X in the shape of an elongated hollow tube of substantially rectangular cross-section and an interior frame member 54Y similarly in the shape of an elongated hollow tube of substantially rectangular cross-section attached to the exterior frame member 54X; the exterior frame member 54X and interior frame member 54Y of the lower horizontal frame member 54 facing the exterior frame member 51X and the interior frame member 51Y, respectively, of the upper horizontal frame member 51. the exterior vertical plate 54*a* of the exterior frame member 54X has a support lug 87 protruding outwardly from the lower end thereof. An L-shaped angle plate 88 is fitted to the support lug 87 to supportingly receive the lower end of the glass pane 8 fitted in the third rectangular opening 57.

Figure 10:
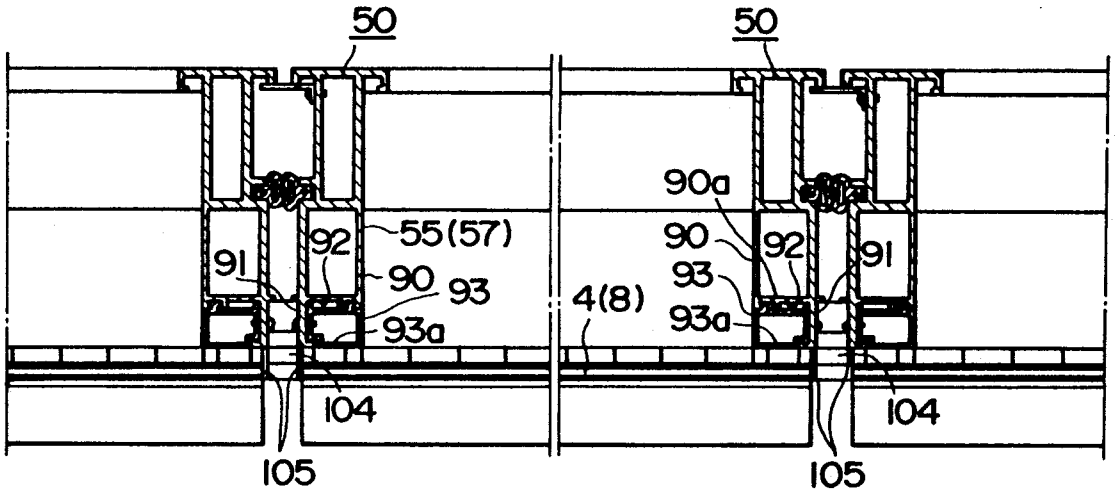
FIG. 10 is a fragmentary horizontal cross-sectional view of the second panel unit of FIG. 8.
Figure 11:
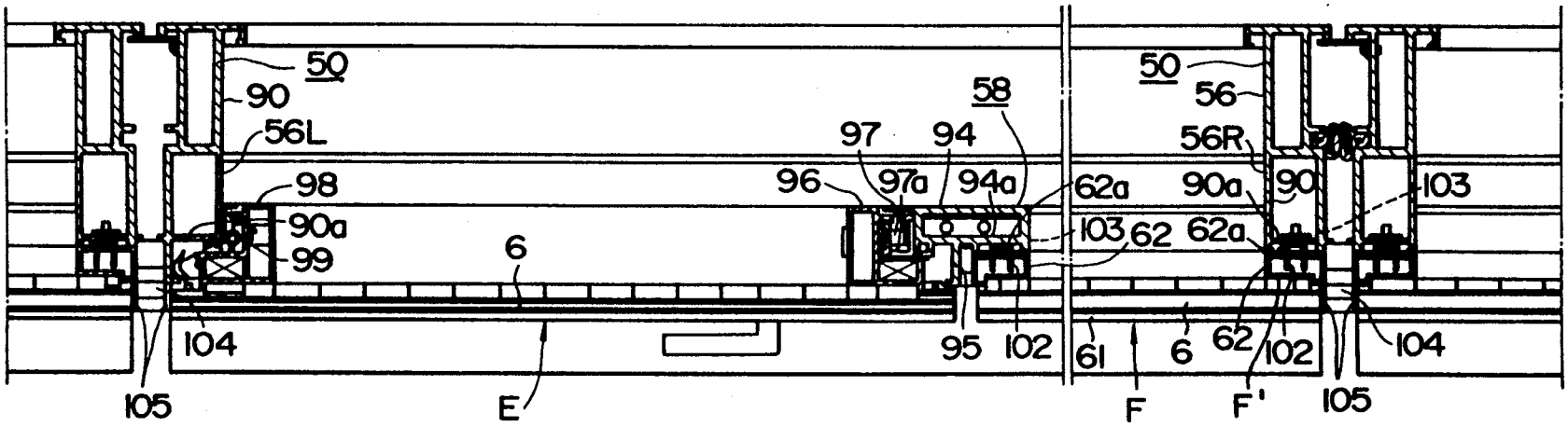
FIG. 11 is a fragmentary horizontal cross-sectional view of the second panel unit of FIG. 8.

As shown in FIGS. 10 and 11, the vertical frame member 50 includes an interior frame member 90 in the shape of an elongated hollow tube of a substantially rectangular cross-section and a protruding vertical wall 91 integrally provided on the interior frame member 90 so as to extend outwardly from an exterior side of the interior frame member 90. The protruding vertical wall 91 and the exterior side of 90*a* of the interior frame member 90 jointly provide a attaching seat 92. Support members 93 are fitted to the attaching seat 92 in its portions corresponding to the first rectangular opening 55 and the third rectangular opening 57, as better shown in FIG. 10. The lateral side edges of the glass panes 4, 8 are bonded to the exterior plates 93*a* of the support members 93.

Figure 1:
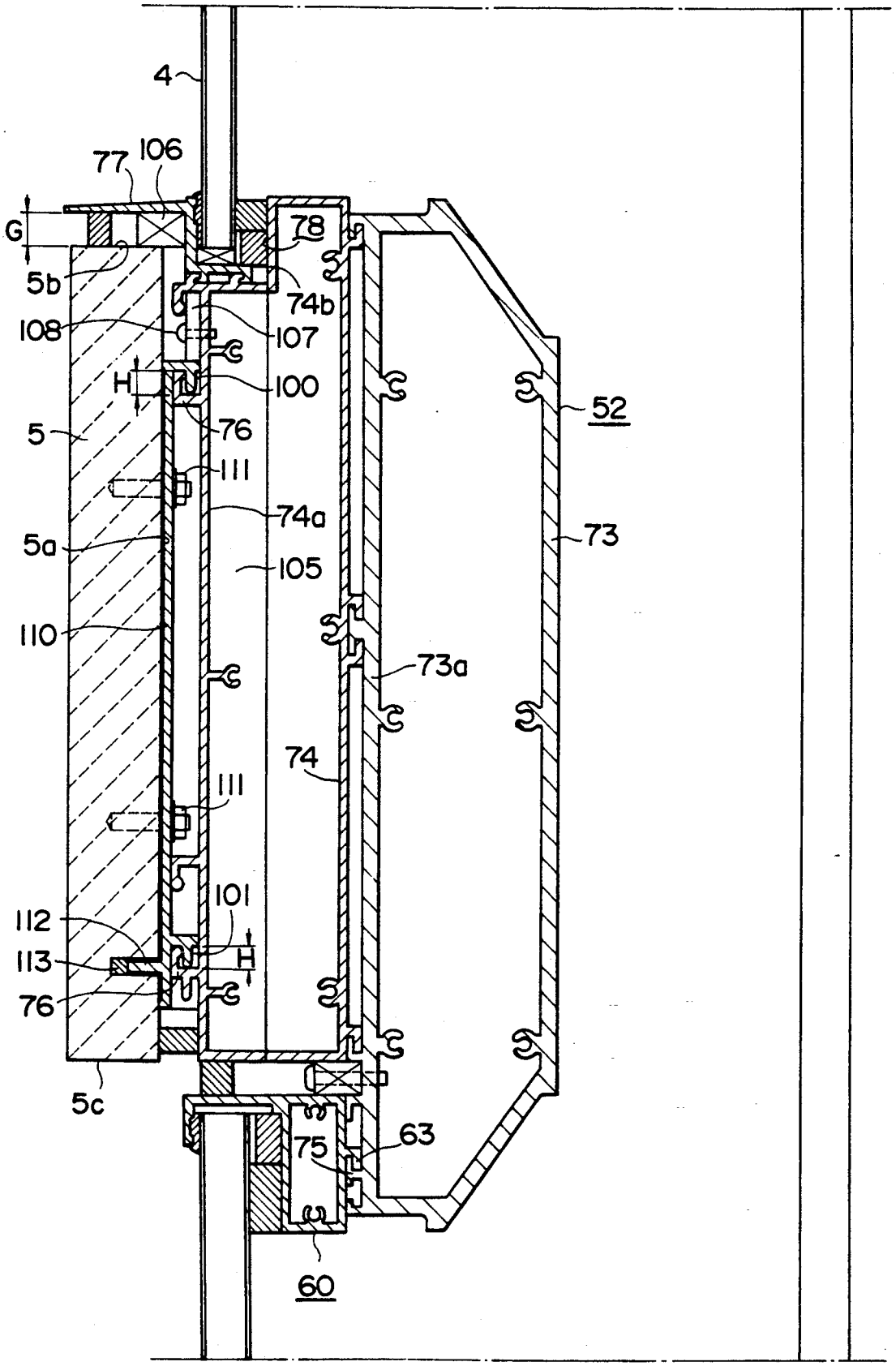
FIG. 1 is a cross-sectional view of a panel fastener construction according to the present invention.

As shown in FIG. 1, the intermediate vertical frame member 58 comprises an interior frame member 94 in the shape of an elongated hollow tube of a substantially rectangular cross-section and a projecting leg 95 provided integrally on the an exterior vertical plate 94*a* of the interior frame member 94 so as to extend outwardly therefrom. The interior frame member 94 has at one lateral side or the left side—as viewed in FIG. 4—a strike plate 97*a* for receiving a lock 97 secured on a corresponding vertical stile 96 of the window sash E. The window sash E is pivotally mounted on the the vertical frame member 50 through a hinge 99 secured thereto.

As shown in FIG. 9, the stone panel 5 has a pair of upper and lower downward catching hooks 100, 101 on the interior side adjacent the upper and lower ends, respectively, thereof. The stone panel 5 is attached to the support frame member 74 by engaging the upper and lower downward catching hooks 100, 101 of the former with the upper and lower upward supporting hooks 76, 76, respectively, of the latter, as more closely described hereinbelow. The stone panels 7 are also attached to the support frame member 81 in much the same manner as the stone panels 5.

Referring now to the construction of attaching the panel unit F, as shown in FIG. 9, the upper horizontal frame member 60 has an upper fitting lug 63 provided integrally on its interior plate 60*a* and the lower horizontal frame member 61 has a lower fitting lug 64 provided integrally on its interior plate 61*a*. The upper and lower fitting lugs 63, 64 are fitted to the fitting projections 75, 82 of the first and second intermediate horizontal frame members 52, 53, respectively. As shown in FIGS. 10, 11, hooks 102, 102 are screwed to the exterior vertical plate 90*a* of the interior vertical frame member 90 of the vertical frame member 52 and a right half portion of the exterior vertical plate 94*a* of the the interior frame member 94 of the vertical mullion 58. The hooks 102, 102 catch the holes 103, 103 formed in the interior vertical plates 62*a*, 62*a* of the right and left vertical frame members 62, 62, so that the panel unit F is attached to the frame 3.

FIG. 1, shows a stone panel 5 being attached to the first intermediate horizontal frame member 52 forming a part of a primary structure by a panel fastener construction according to the present invention. Now, detailed description of the panel fastener construction is made in conjunction with FIG. 1. The upper and lower downward catching hooks 100, 101 are integrally formed on a base plate 100 in the shape of a flat metal sheet on its interior side. The upper and lower downward catching hooks 100, 101 are provided at the upper edge and adjacent the lower edge, respectively, of the base plate 110. The base plate 110 is less in length than the stone panel 5. The base plate 110 also has a support lug 112 integrally provided on its exterior side. The support lug 112 is disposed slightly lower than the lower downward catching hook 101. This means that the support lug 113 lies substantially in registry with the lower upward supporting hook 76 of the support frame member 74, when the stone panel 5 is attached to the support frame member 74. The stone panel 5 has a bore 113 formed in its interior side adjacent its lower edge. The base plate 110 is attached to the interior surface of the stone panel 5 by means of screws 111 with the support lug 112 fit into the bore 113. The support lug 112 functions to support the gravity of the stone panel 5.

The upper and lower downward catching hooks 100, 101 of the stone panel 5 are brought into fitting engagement with the upper and lower upward supporting hooks 76, 76 provided on the exterior vertical plate 74*a* of the support frame member 74 of the first intermediate horizontal frame member 52, so that the stone panel 5 is attached to the first intermediate horizontal frame member 52. It is to be noted here that the height (H) of the upper and lower downward catching hooks 100, 101 representing the depth of engagement between the downward catching hooks 100, 101 and the upward supporting hooks 76, 76 is slightly less than a gap G between the upper edge 5*b* of the stone panel 5 and the lower edge of another panel construction just above the stone panel 5—specifically speaking, the angle strip 77 conforming the panel construction of the glass pane 4 in FIG. 1—. When referring to the gap G between vertically adjacent panels, the word "panel" is to be construed as meaning, in addition to a panel proper, a whole panel construction including a panel frame or other parts associated with the panel, except where the contrary clearly follows from the context in which the word is used. Furthermore, a filler block 106 is inserted into the gap G and screwed to the angle strip 77 to prevent the stone panel 5 from moving upwardly.

FIG. 1 only shows one base plate 110 with the upper and lower downward catching hooks 100, 101, however, in fact, there are a plurality of the base plates 110 mounted on the interior surface of the stone panel 5 so as to horizontally spaced from each other. On the other hand, the upper and lower upward supporting hooks 76, 76 extend over the substantially entire length of the exterior vertical plate 74*a* of the support frame member 74. This would make it likely for the upper and lower downward catching hooks 100, 101 of the stone panel 5 to accidentially move horizontally along the upper and lower upward supporting hooks 76, 76, thus displacing the stone panel 5 horizontally. For preventing the stone panel 5 from displacing horizontally, a plurality of setting plates 107 are inserted one into each end of each of the upper and lower upward supporting hooks 76, 76, so that each setting plate 107 comes into abutting engagement with the respective downward catching hook 100, 101.

Although, in the preceding embodiment, the upper and lower downward catching hooks 100, 101 are integrally formed on the base plate 110, a pair of upper and lower downward catching hooks 40, 41 may be provided separately adjacent the upper and lower ends, respectively, of the interior surface of the stone panel 5.

With the above-described construction of the panel fastener construction according to the present invention, even when attaching a building stone panel to a building or a panel frame constituting a primary structure just beneath another stone panel already attached, the building panel 5 can be attached in place to the primary structure without being interferred by the upper building panel.

Consequently, a plurality of building panels can be attached to the primary structure either from the top or from the bottom thereof of from any other position. Furthermore, at whatever position a broken panel may be, the broken panel can be replaced with a new one merely by taking out only that very broken pane.

Besides, since the base plate 110 with the upper and lower downward catching hooks 100 and 101 is less in length than the stone panel 5, the stone panel 5 completely conceals the base plate 110 behind itself, thus heightening the appearance of the panel construction and hence the building as a whole.

The gravity of the stone panel 5 primarily focuses upon the support lug 112 of the base plate 110 which support lug 112 lies substantially in registry with the lower upward supporting hook 76 which supports the gravity of the stone panel 5. This helps prevent the lower upward supporting hooks 76 from being subject to severe bending stresses, thus holding it immune from deformation.

Obviously, various modifications and variations of the present invention are possible in the light of the above teaching. It is therefore to be understood that within the scope of the appended claims the invention may be practiced otherwise than as specifically described.

What is claimed is:

1. A panel fastener construction for fastening a plurality of building panels to a primary structure with a uniform gap interposed between each vertically adjacent pair of panels, the panel fastener construction comprising (a) a plurality pair of upper and lower upward supporting hooks provided on the primary structure with the upper and lower upward supporting hooks vertically spaced from each other;

(b) means on each building panel for engaging the panel with the upper and lower upward supporting hooks, the engaging means including a pair of upper and lower downward catching hooks provided on the interior side of each panel for engagement with the upper and lower upward supporting hooks, respectively, of the primary structure, the height of the downward hooks being slightly less than the gap; and (c) a filler block inserted and retained in the gap to prevent the panel from moving upwardly, said filler block being attached by screw to the primary structure.

2. A panel fastener construction according to claim 1, the panels being stone panels.

3. A panel fastener construction according to claim 1, the engaging means further including a base plate having the upper and lower downward catching hooks integrally provided on its interior side on the upper edge and adjacent the lower edge, respectively, thereof, the exterior side of the base plate being secured to the interior side of the building panel.

4. A panel fastener construction according to claim 1, the upper and lower downward catching hooks being separately attached to the interior side of the building panel.

5. A panel fastener construction according to claim 1, each of the panels being a rectangular panel unit comprising a frame including a pair of vertical frame members and a pair of upper and lower horizontal frame members each connected at its opposite ends with the respective ends of the vertical frame members and a glass pane attached to the frame; the interior surface of the glass pane 6 being bonded along its peripheral edges to the the vertical frame members and the upper and lower horizontal frame members; the upper and lower horizontal frame members having at their respective interior sides the upper and lower downward catching hooks.

6. A panel fastener construction according to claim 1, the building panel having a groove formed in its interior side adjacent its lower end, the lower downward catching hook having a support lug extending therefrom, the support lug being fitted into the groove, the support lug coming into registry with the lower upward supporting hook of the primary structure.

7. A panel fastener costruction according to claim 1, the upper and lower downward catching hooks being completely concealed behind the building panel.

* * * * *